US007141781B2

(12) United States Patent
Hagmann

(10) Patent No.: US 7,141,781 B2
(45) Date of Patent: Nov. 28, 2006

(54) EFFICIENT HIGH-FREQUENCY ENERGY COUPLING IN RADIATION-ASSISTED FIELD EMISSION

(76) Inventor: Mark J. Hagmann, 762 Lacey Way, North Salt Lake, UT (US) 84054

( * ) Notice: Subject to any disclaimer, the term of this patent is extended or adjusted under 35 U.S.C. 154(b) by 0 days.

(21) Appl. No.: 10/459,828

(22) Filed: Jun. 11, 2003

(65) Prior Publication Data

US 2003/0226961 A1 Dec. 11, 2003

Related U.S. Application Data

(60) Provisional application No. 60/387,837, filed on Jun. 11, 2002.

(51) Int. Cl.
*H01J 3/14* (2006.01)

(52) U.S. Cl. ..... 250/234; 250/207; 343/701; 343/720; 343/721

(58) Field of Classification Search ..... 343/720–721, 343/701; 250/207, 234, 306; 313/537; 324/752
See application file for complete search history.

(56) References Cited

U.S. PATENT DOCUMENTS 5,508,627 A * 4/1996 Patterson ..... 324/752
6,153,872 A * 11/2000 Hagmann et al. ..... 250/207

OTHER PUBLICATIONS

Peter H. Siegel, Fellow, IEEE "Terahertz Technology", IEEE Transactions on Microwave Theory and Techniques, vol. 50, No. 3 Mar. 2002; pp. 910-928.

E.R. Brown, F. W. Smith and K.A McIntosh "Coherent Millimeter-wave Generation by Heterodyne Conversion in Low-temperature-grown GaAs Photoconductors", J. Appl. Phys. 73 (3), Feb. 1 1993; p. 1480-1463.

Mark J. Hagmann "Stable and Efficient Numerical Method for Solving the Schrodinger Equation to Determine the Response of Tunneling Electrons to a Laser Pulse", International Journal of Quantum Chemistry, vol. 70, pp. 703-710 (1998) No. 4/5.

L. Arnold and W. Krieger, H. Walter "Laser-frequency mising using the scanning tunneling microscope", J. Vac. Sci. Technol. A 6 (2), Mar./Apr. 1988; p. 466-469.

Mark J. Hagmann "Simulations of photon-assisted field emission; their significance in basic science and device applications", Ultramicroscopy 79 (1999); p. 115-124

Mark J. Hagmann "Simulations of the generation of broadband signals from DC to 100 THz by photomizing in laser-assisted field emission", Ultramicroscopy 73 (1998); p. 89-97.

S.K. Masalmeh, H.K.E. Stadermann, J. Korving "Mixing and rectification properties of MlM diodes", Physica B 218 (1996); p. 56-59.

(Continued)

*Primary Examiner*—Tho Phan
*Assistant Examiner*—Chuc Tran
(74) *Attorney, Agent, or Firm*—Kunzler & Associates

(57) ABSTRACT

An improved device, method, and system efficiently couple high-frequency energy from radiation-assisted field emission. A radiation source radiates an emitting surface with an electromagnetic field. The electromagnetic field reduces the potential barrier at the emitting surface, allowing electrons to tunnel from the surface. The tunneling electrons produce a current. The electron tunneling current oscillates in response to the oscillations of the electromagnetic field radiation. Two or more electromagnetic fields of different frequencies radiate the emitting surface, causing photomixing. The electron tunneling current oscillates in response to the difference of the frequencies of the electromagnetic fields.

46 Claims, 13 Drawing Sheets

OTHER PUBLICATIONS

Mark J. Hagmann "Stimulations of Laser-Assisted filed Emission Within the Local Density Approximation of Kohn-Sham Density-Functional Theory", International Journal of Quantum Chemistry, vol. 65, No. 5, p. 857-865 (1997).

Mark J. Hagmann "Single-Photon and Multiphoton Processes Causing Resonance in the Transmission of Electrons by a Single Potential Barrier in a Radiation Field", International Journal of Quantum Chemistry, vol. 75 No. 4/5, p. 417-427 (1999).

Mark J. Hagmann "Mechanism for Resonance in the Interaction of Tunneling Particles with Modulation Quanta", J. Appl. Phys. 78 (1), Jul. 1995; p. 25-29.

Alexandre Mayer and Jean-Pol Vigneron "Quantum-Mechanical Simulations of Photon-stimulated field emission by Transfer Matrices and Green's functions", Physical Review B, vol. 62, No. 15 Dec. 2000-1; p. 16 138- 16 145.

Mayer, N. M. Miskovsky, and P.H, Cutler "Photon-stimulated field Emission from Semiconducting (10, 0) and Metallic (5, 5) carbon Nanotubes" Physical Review B, vol. 65, 195416; p. 195416-1-195416-6, (1954).

A. Mayer, N. M. Miskovsky and P.H. Cutler "Three-dimensional Simulations of Field Emission through an Oscillating Barrier from a (10,0) Carbon Nanotube", J. Vac. Sci. Technol. B 21(1), Jan./Feb. 2003; p. 395-399.

Georg Goubau "Surface Waves and Their Application to Transmission Lines", Journal of Applied Physics, vol. 21 Nov. 1950; p 1119-1128.

Karen N. Kocharyan, Mohammed Nurul Afsar, and Igor I, Tkachov "Millimeter-Wave Magnetooptics: New Method for characterization of Ferrites in a MIllimeter-Wave Range", IEEE Transactions on Microwave theory and tech., vol. 47, No. 12 Dec. 1999; p. 2636-2643.

W. Zhu, C. Bower and O. Zhou, and G. Kochanski and S Jin "Large Current Density from Carbon Nanotube Field Emitters", Applied Physics Letters, vol. 75, No. 6, Aug. 9, 1999; p. 873-875.

R. Tarkiainen, M. Ahlskog, J. Penttila, L. Roschier, P. Hakonen, M. Paalanen, and E. Sonin "Multiwalled Carbon Nanotube: Luttinger. Versus Fermi Liguid", Physical Review B, vol. 64, 195412, p. 195412-1-195412-4, (1954).

Markus Ahiskog, Pertti Hakonen, Mikko Paalanen, Leif Roschier, and Reeta Tarkiainen "Multiwalled Carbon Nanotubes as Building Blocks in Nanoelectronics", Journal of Low Temperature Physics, vol. 124, Nos. 1/2, 2001; p. 335-352.

A. Bachtold, M. de Jonge, K. Grove-Rasmussen, and P. L. McEuen "Suppression of Tunneling into Multiwall Carbon Nanotubes", Physical Review Letters, vol. 87, No. 16 Oct. 15, 2001; p. 166801-1-166801-4.

P.J. Burke "An RF Circuit Model for Carbon Nanotubes", IEEE Transactions on Nanotechnology, vol. 2, No. 1 Mar. 2003; p. 55-58.

D. B. Rutledge, S. E. Schwarz and A. T, Adams "Infrared and Submillimetre Antennas", Infrared Physics Dec. 18 1978; p. 713-729.

* cited by examiner

EFFICIENT HIGH-FREQUENCY ENERGY COUPLING IN RADIATION-ASSISTED FIELD EMISSION

RELATED APPLICATIONS

This application is a continuation-in-part of and claims priority to U.S. Patent Application No. 60/387,837, filed on Jun. 11, 2002 and entitled "MEANS AND METHODS FOR THE EFFICIENT COUPLING OF HIGH-FREQUENCY ENERGY TO AND FROM THE EMITTING TIP IN PHOTON-ASSISTED FIELD EMISSION" and which is incorporated herein by reference.

BACKGROUND OF THE INVENTION

1. The Field of the Invention

The invention relates to devices, methods, and systems for field emission oscillators and modulators. Specifically, the invention relates to devices, methods, and systems for high-frequency energy coupling in radiation-assisted field emission.

2. The Relevant Art

The increasing performance demands of high-speed computing and communications require the generation of electromagnetic signals at ever-higher frequencies. High-frequency signals are needed to exploit opportunities for higher-speed processing and data transmission. High-frequency signals are also essential for many new applications such as imaging and spectroscopy for identification of molecules in chemical and biological agents or communications signals capable of propagating through highly ionized gases.

Yet the physical constraints of materials and electromagnetic radiation have limited the generation of switchable, tunable signals at frequencies of one terahertz and above. The high-frequency characteristics of vacuum tubes are limited by physical scaling and metallic loses. The high-frequency characteristics of semiconductor-based electronic devices are limited by resistive loses, reactive parasitics, and carrier transit delays. These limitations result in sharp power roll-offs above 1 Terahertz.

The operating frequencies of electronic devices have been increased by taking advantage of the higher switching speeds of optoelectronic devices. The Auston Switch uses pulsed lasers to modulate the conductivity of a photoconductive substrate such as Gallium Arsenide (GaAs). The laser pulse excites electrons from a valence band to a conduction band, changing the substrate from an insulator to a conductor. Auston Switches have switching times of about 500 fs, allowing them to generate extremely narrow electrical pulses or high-frequency signals.

Lasers have also been used to modulate the current in field emission or Fowler-Nordheim tunneling. In field emission, an applied electric field reduces the potential barrier at the surface of a metal or semiconductor. When the potential barrier is reduced to be near the Fermi level of the electrons, the electrons "tunnel" from the metal or semiconductor. The tunneling electrons create an electric current.

A laser pulse can modulate the tunneling of electrons. The response time of field emission to a laser pulse can be as brief as 2 fs, less than one per cent of the response time of the photoconductive substrate in an Auston Switch. Laser-modulated field emission-based devices could be used for high-frequency switching and signal generation. For example, two lasers of different frequencies may excite a tunneling current that oscillates at the difference of the laser frequencies.

In a radiation-assisted field emission device, one or more lasers radiate to an emitting surface, producing a tunneling electron current. The tunneling electron current oscillates or switches at extremely high frequencies. Radiation assisted field emission devices are capable of producing extremely high-frequency signals with high frequency agility, the ability to rapidly change the output frequency. However, the high-frequency response pertains only to the current emitted from the apex of an emitting tip. The high-frequency energy must be effectively coupled for field emission devices to have practical application as switches or signal generators.

U.S. Pat. No. 6,153,872 teaches three techniques for coupling high-frequency energy from the apex of a field-emitting tip. U.S. Pat. No. 6,153,872 is incorporated herein by reference. The techniques include: coating the metal emitting tip with a dielectric so that a Goubau wave may propagate energy along the tip to a load; using a Sommerfeld wave to excite a dielectric waveguide to carry energy to a load; and forming a traveling-wave antenna to radiate energy to a second antenna connected to a load. Although the techniques of U.S. Pat. No. 6,153,872 are partially effective, additional enhancements are required for practical application to laser-modulated field emission devices.

Nanoscale field emission tubes have been built and field emitter arrays with as many as $10^{10}$ tips per square centimeter are now used in flat panel displays. Miniature multi-function field emission devices could be built if energy could be efficiently transmitted from field emissions. What is needed is an improvement to the energy coupling from field emission devices, to increase the useful energy from radiation-assisted field emission devices. Improved energy coupling will support the creation of practical terahertz sources.

SUMMARY OF THE INVENTION

The various elements of the present invention have been developed in response to the present state of the art, and in particular, in response to the problems and needs in the art that have not yet been fully solved by currently available devices, methods, and systems for coupling oscillations in the field emission current. Accordingly, the present invention provides an improved device, method, and system for efficiently coupling high-frequency energy from radiation-assisted field emission.

In one aspect of the present invention, an apparatus for efficient high-frequency energy coupling in radiation-assisted field emission is presented. A radiation source radiates an emitting surface with an electromagnetic field. The electromagnetic field reduces the potential barrier at the emitting surface, allowing electrons to tunnel from the surface. The tunneling electrons produce a current. The electron tunneling current oscillates in response to the oscillations of the electromagnetic field radiation. In one embodiment, two or more electromagnetic fields of different frequencies radiate the emitting surface, causing photomixing. The electron tunneling current oscillates in response to the difference of the frequencies of the electromagnetic fields.

The diameter of the emitting surface is preferably smaller than the wavelength of the electromagnetic field. The current density of the tunneling electron current does not exceed the current tolerance of the emitting surface material. The emitting surface may include semiconducting inclusions, microprotusions, and multiple emitter sites to increase the effective area of the emitting surface.

A transmission device is in one embodiment coupled to the emitting surface. The transmission device presents the oscillations in the tunneling electron current with a high impedance. The oscillations in the tunneling electron current function as a constant current source, the high impedance of the transmission device increasing the power coupled through the transmission device. The electric field caused by the interaction of the tunneling electron current oscillations and the high impedance creates an electric field that opposes the current oscillations. The high impedance of the transmission device is less than the impedance sufficient to produce appreciable negative feedback that reduces the power that is output from the transmission device.

The transmission device in one embodiment couples the energy of the oscillations in the tunneling electron current with a load where the high-frequency energy is employed. The impedance profile of the transmission device may be rapidly tapered over a short distance from the high impedance to a lower impedance. The lower impedance may match the impedance of the load, reducing reflections. In one embodiment, the transmission device is a transmission line. The transmission line may be a conductor coated with a dielectric such as a Goubau line. In an alternate embodiment, the transmission device is a transmitting antenna coupled with a receiving antenna that is connected to the load.

In one embodiment, the wavelength of the electromagnetic field is such that one photon will elevate a tunneling electron above the potential barrier at the emitting surface to an energy where one complete cycle of the tunneling electron wave function occurs in the round-trip path between the classical turning points to resonantly reinforce the wave function. In an alternate embodiment, the wavelength of the electromagnetic field is chosen so that the resonance will not occur.

In one embodiment, the emitting surface is biased with an applied DC electric field. The applied DC electric field bends the potential barrier of the emitting surface, allowing electron tunneling. The cathode is the emitting surface. The anode, which collects the electrons, is small and set at a distance from the emitting surface to reduce capacitive effects.

In another aspect of the present invention, a method for selecting the impedance of a transmission device is presented. The transmission device couples energy from an emitting surface. The emitting surface functions as a constant current source. The method sets the impedance of the transmission device coupling with the emitting surface at an initial low value. The impedance of the transmission device coupling is increased, increasing the energy output from the transmission device. The method selects the impedance where the decrease in coupled energy resulting form the incremental negative current feedback produced by the increased impedance of the coupling between the transmission device and the emitting surface exceeds the incremental increase in the coupled energy from the increased impedance.

Various elements of the present invention are combined into a system for efficient high-frequency energy coupling in radiation-assisted field emission are presented. A radiation source radiates an emitting surface with an electromagnetic field. The emitting surface is located within an evacuated chamber. The electromagnetic field reduces the potential barrier at the emitting surface, allowing electrons to tunnel from the surface as a tunneling electron current. The diameter of the emitting surface is smaller than the wavelength of the electromagnetic field.

A transmission device with a high impedance is coupled to the emitting surface within an evacuated chamber. The transmission device couples the energy of the oscillations in the tunneling electron current with a load outside of the evacuated chamber. In one embodiment, the emitting surface and the transmission device are located within a cavity of the radiation source.

The present invention facilitates the coupling of high-frequency energy from a field emission device. The invention further supports the generation of a high-frequency tunable signal. The various elements and aspects of the present invention enable high-frequency electromagnetic sources for communications, data processing, imaging, and spectroscopy. These and other features and advantages of the present invention will become more fully apparent from the following description and appended claims, or may be learned by the practice of the invention as set forth hereinafter.

BRIEF DESCRIPTION OF THE DRAWINGS

In order that the manner in which the advantages and objects of the invention are obtained will be readily understood, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
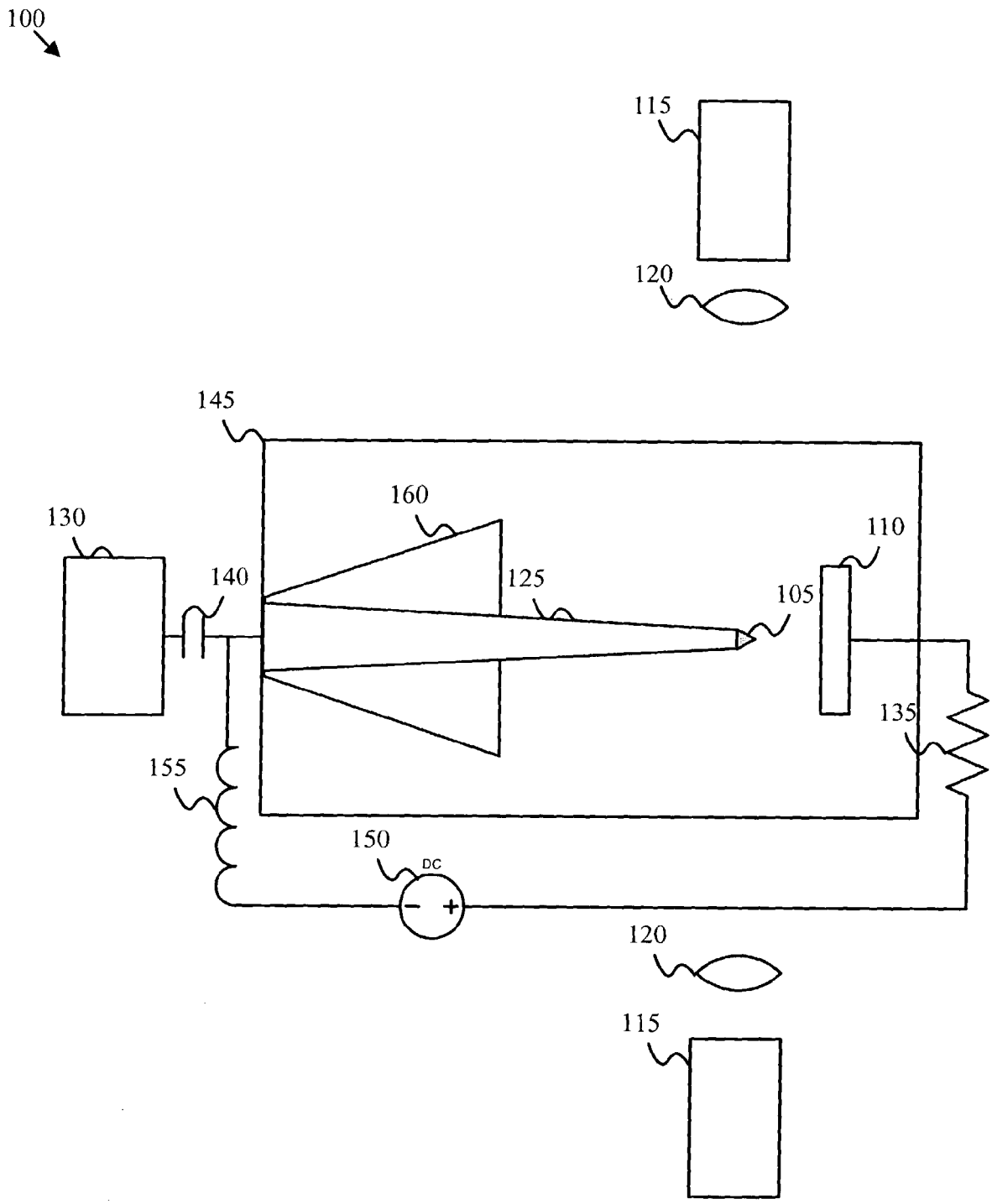
(Prior Art) Fig. 1
FIG. 1 is a schematic diagram illustrating a field emission system of the prior art.

FIG. 1 is a drawing illustrating a field emission system 100 of the prior art. The system 100 includes an emitting surface 105, an anode 110, one or more lasers 115, one or more optical devices 120, a transmission device 125, a load 130, a resistor 135, a coupling capacitor 140, an evacuated chamber 145, a DC source 150, a RF choke 155, and a horn transition 160.

The DC source 150 creates a DC electric field between the emitting surface 105 and the anode 110. The resistor 135 limits the current provided by the DC source 150. The coupling capacitor 140 blocks the DC voltage signal from entering the load 130. The RF choke 155 blocks high frequency signals from entering the DC source 150.

The laser 115 emits an electromagnetic field. The beam of the laser 115 may be focused by one or more optical devices 120. The electromagnetic field radiates the emitting surface 105, further deforming the potential barrier at the emitting surface 105. The tunneling electron current oscillates in response to the radiation of the electromagnetic field. In one embodiment one or more lasers 115 emit electromagnetic fields.

The transmission device 125 couples the tunneling electron current oscillations from the emitting surface 105 to the load 130. The horn transition 160 increases energy transmission. Because of inefficiencies in the coupling of energy from the emitting surface 105 to the load 130 by the transmission device 125, the tunneling electron current has been difficult to employ in practical applications.

Figure 2:
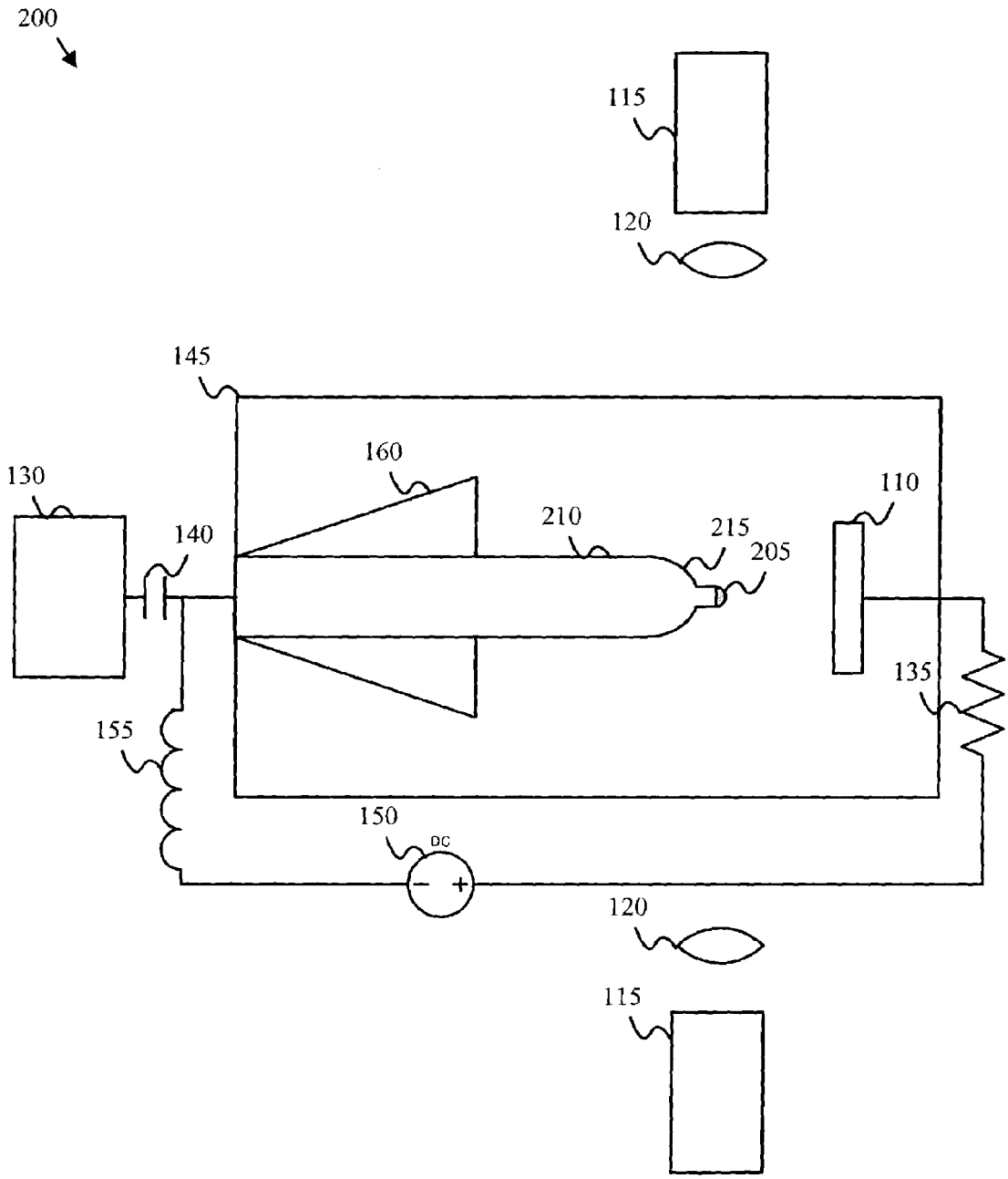
FIG. 2 is a schematic diagram illustrating one embodiment of a field emission system of the present invention.

FIG. 2 is a drawing illustrating a field emission system 200 of the present invention. The system 200 efficiently couples energy to an external load. The field emission system 200 includes an anode 110, one or more lasers 115, one or more optical devices 120, a load 130, a resistor 135, a coupling capacitor 140, an evacuated chamber 145, a DC source 150, and a RF choke 155, a horn transition 160, an emitting surface 205, a transmission device 210, and an impedance transition interval 215.

The DC source 150 creates a DC electric field between the emitting surface 205 and the anode 110. The resistor 135 limits the current provided by the DC source 150. The coupling capacitor 140 blocks the DC voltage signal from entering the load. The RF choke 155 blocks RF signals from entering the DC source 150.

The DC electric field is preferably in the range of 2 to 9 Volts/nm, deforming the potential barrier at the surface of the emitting surface 205 and creating a tunneling electron current. The laser 115 radiates an electromagnetic field to the emitting surface 205, further deforming the potential barrier and increasing the tunneling electron current. In one embodiment, an optical device 120 focuses the optical field. In one embodiment, one or more lasers 115 radiate the emitting surface 205. The tunneling electron current varies in response to the radiation of the laser's 115 electromagnetic field.

The emitting surface 205 is located within the evacuated chamber 145. The emitting surface 205 is constructed of a conductor material such as tungsten. The emitting surface 205 may also be constructed of a semiconductor material such as gallium arsenide, zirconium carbide, gallium nitride, aluminum nitride, molybdenum silicide, silicon fibrils, hafnium carbide and diamond-like carbon. In one embodiment, the emitting surface 205 is coated with a dielectric material. Dielectric materials that may be used include diamond-like-carbon and high resistivity silicon. Semiconducting inclusions may also be dispersed in emitting surface.

In one embodiment, the emitting surface 205 is embedded with silver, aluminum, or gallium. These materials produce surface plasmons to enhance the strength of the electromagnetic field by up to 60 dB.

The diameter of the emitting surface 205 is less than the wavelength of the electromagnetic field. In one embodiment, the diameter of the emitting surface 205 is less than 50 percent of the wavelength of the electromagnetic field. The small diameter of the emitting surface 205 relative to the wavelength of the electromagnetic field allows the potential barrier at the emitting surface 205 to change through each oscillation of the electromagnetic field.

The structure of the emitting surface 205 maximizes the area of the emitting surface 205. In one embodiment, the emitting surface 205 has multiple emitter sites. The emitting surface 205 may also be provided with microprotusions, macrooutgrowths, or carbon nanotubes. The emitting surface 205 has sufficient area to couple the tunneling electron current without exceeding the current density limit of the emitting surface 205 material.

The tunneling electron current oscillations from the emitting surface 205 are coupled to the transmission device 210. The transmission device 210 couples the energy of the tunneling electron current oscillations to a load 130. The horn transition 160 increases energy transmission. The coupled energy from the emitting surface 205 is increased because the transmission device 210 presents a high impedance to the emitting surface 205. The coupled energy along the transmission device 210 is enhanced by rapidly reducing the impedance profile of the transmission device 210 over a short distance. The transmission device 210 impedance profile is reduced from the high impedance of the emitting surface 205 coupling to an impedance matching to the load 130. In one embodiment, the impedance profile of the transmission device 210 is tapered over a short distance in the impedance transition interval 215.

In one embodiment, transmission device 210 couples energy as electromagnetic radiation by guided propagation. A guided propagation transmission device 210 may include an open metal structure and a dielectric waveguide. In an alternate embodiment, the energy of the transmission device 210 is directed by an optical device. Optical devices including a lens, a mirror, and a diffraction grating may be employed. Optical devices reduce the energy losses due to the resistance of metal.

In one embodiment, the transmission device 210 is a conductor. The conductor propagates energy as a transverse magnetic surface wave. In one embodiment, the transmission device is a helical conductor. The helical conductor has a high inductance, increasing the impedance of the transmission device and the energy coupled. The conductor and the emitting surface 205 may be constructed of a single carbon nanotube. In one alternate embodiment, the conductor comprises two or more carbon nanotubes.

In one embodiment, the conductor is coated with a ferrite material such as strontium-hexaferrite. In an alternate embodiment, the conductor is comprised of a conducting ferrite material such as strontium-hexaferrite. A static magnetic field may be applied parallel to the axis of the ferrite material to cause gyromagnetic resonance of the ferrite, increasing the permeability and the impedance of the transmission device.

In one embodiment, the electromagnetic field of the laser 115 has a wavelength selected such that one photon will take a tunneling electron above the potential barrier to an energy where that one complete cycle between the classical turning points of the tunneling electron reinforces the wave function of the tunneling electron. The resonant reinforcing of the wave function increases the quality factor of the device and enhances the effect of the electromagnetic radiation on the tunneling electron current by as much as 50 dB.

In an alternate embodiment, the electromagnetic field of the laser 115 has a wavelength selected such that there is little or no resonant reinforcing of the wave function, which decreases the quality factor of the device to increase the frequency agility.

The field emission system 200 is highly non-linear and highly responsive to the coupling between the emitting surface 205 and the load 130 by the transmission device 210. The configuration of the transmission device 210 may be used to greatly enhance selected harmonics or mixer terms of the output signal. In one embodiment, the transmission device 210 may be tuned so that the field emission system 200 functions as a photomixer with high frequency agility and a broad tunable frequency range. In another embodiment the DC source 150 may be set at a low potential, even zero, and the intensity of the electromagnetic field may be increased to cause a tunneling electron current.

In one embodiment, the system 200 functions in reverse as a modulator because of electromagnetic reciprocity. An input signal is applied to the load 130 and coupled through the transmission device 210 to the emitting surface 205. A laser 115 focuses a first electromagnetic wave on the emitting surface 205, producing a second electromagnetic wave offset from the frequency of the first electromagnetic wave by the frequency of the input signal.

Figure 3:
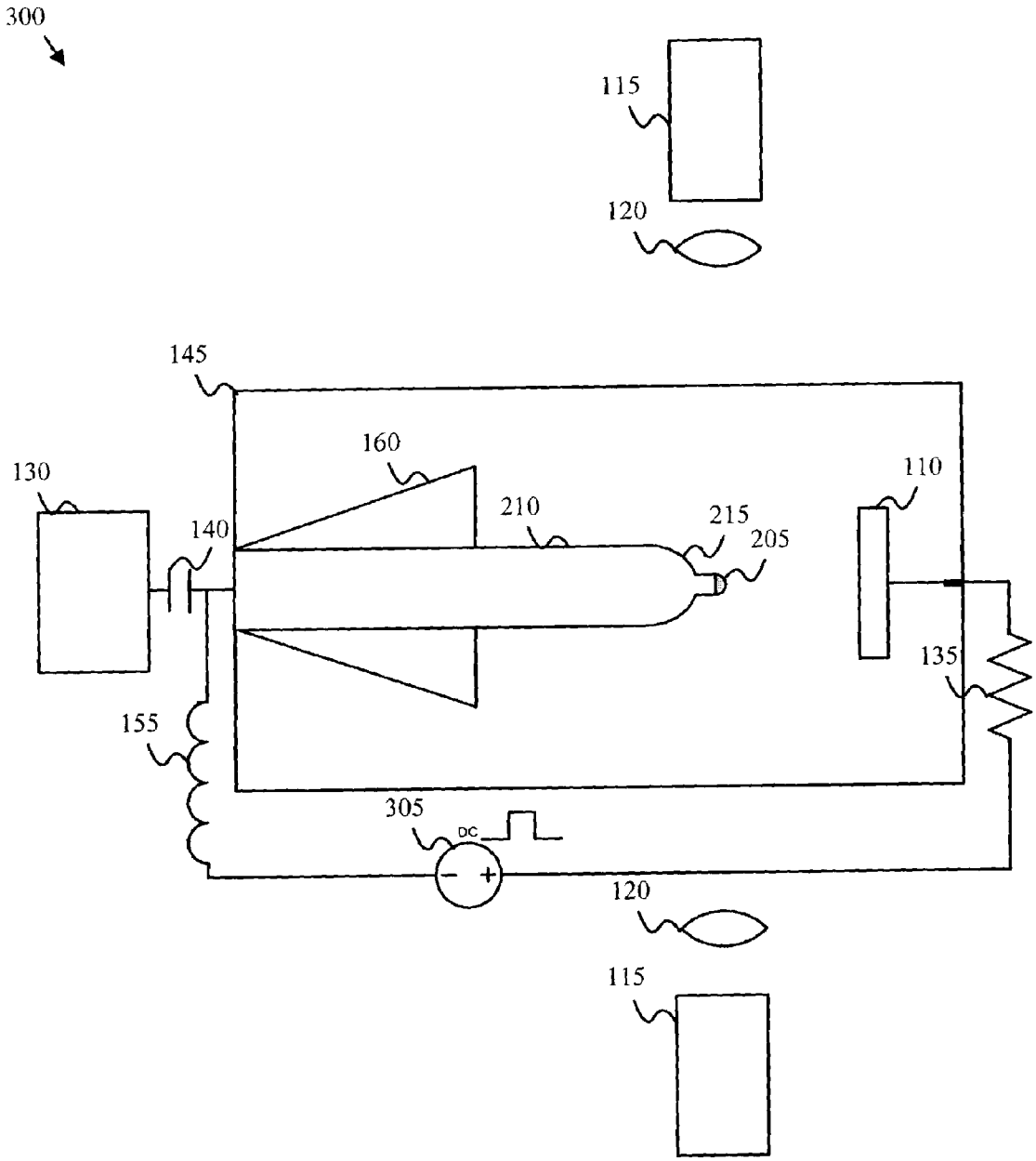
FIG. 3 is a schematic diagram illustrating one embodiment of a field emission system of the present invention.

FIG. 3 is a schematic diagram illustrating a pulse generating field emission system 300 of the present invention. The field emission system 300 includes an emitting surface 205, an anode 110, one or more lasers 115, one or more optical devices 120, a transmission device 210, a load 130, a resistor 135, a coupling capacitor 140, an evacuated chamber 145, a RF choke 155, a horn transition 160, a transmission device 210, an impedance transition interval 215, and a pulse generating DC source 305.

The pulse generating DC source 305 in this embodiment generates a DC pulse. The pulse may be 1 microsecond or less in duration. The emitting surface 205 tolerates high levels of pulsed current density, typically 1000 times the level tolerated for a steady state field. In one embodiment, the pulse generating DC source 305 generates a DC pulse summed with a steady state DC voltage.

Figure 4:
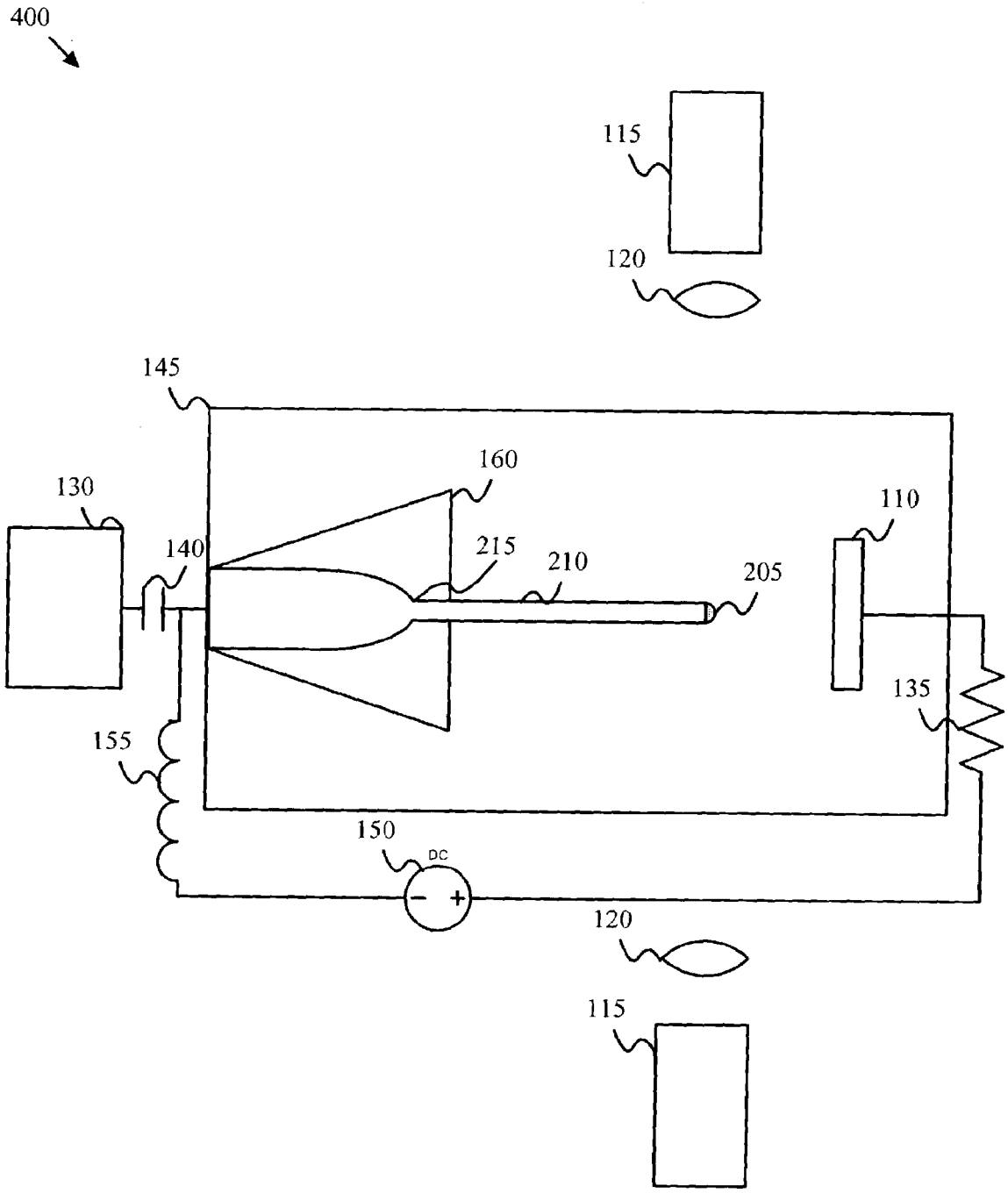
FIG. 4 is a schematic diagram illustrating one embodiment of a field emission system of the present invention.

FIG. 4 is a schematic diagram illustrating an alternative embodiment of a field emission system 400 of the present invention. The system 400 includes an anode 110, one or more lasers 115, one or more optical devices 120, a load 130, a resistor 135, a coupling capacitor 140, an evacuated chamber 145, a DC source 150, a RF choke 155, a horn transition 160, an emitting surface 205, a transmission device 210, and an impedance transition interval 215. The impedance transition interval 215 is located at a distance from the emitting surface, tapering the high impedance of the emitting surface 205 coupling to the transmission device 210 to a lower impedance matching the load 120.

Figure 5:
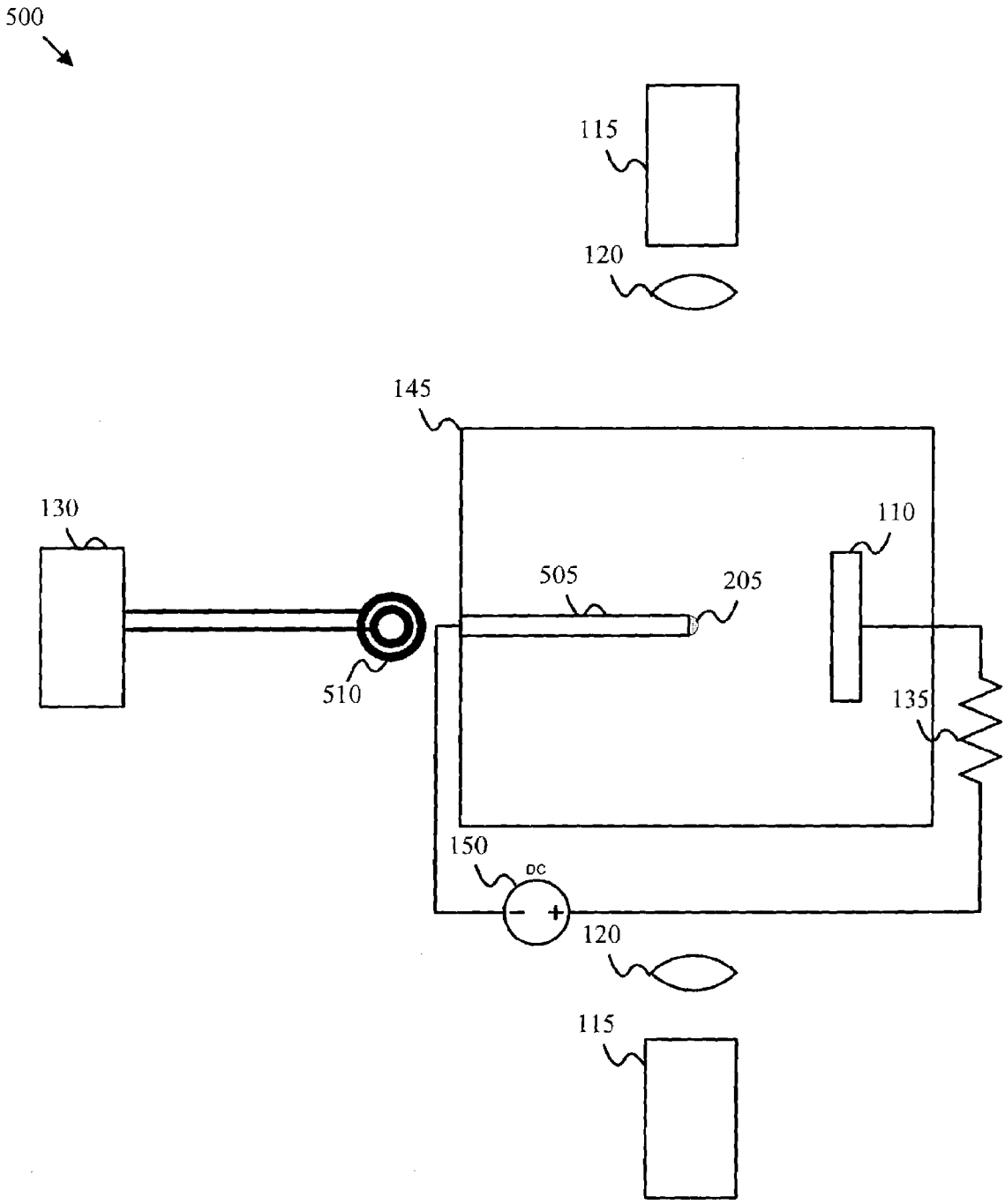
FIG. 5 is a schematic diagram illustrating one embodiment of a field emission system of the present invention.

FIG. 5 is a schematic diagram illustrating an alternative embodiment of a field emission system 500 of the present invention. The system 500 includes an emitting surface 205, an anode 110, one or more lasers 115, one or more optical devices 120, a load 130, a resistor 135, an evacuated chamber 145, a DC source 150, a conductor 505, and two or more concentric annular rings 510. The concentric annular rings 510 form a dipole-receiving antenna. The conductor 505 forms an antenna. The conductor 505 maybe much longer than the wavelength of the tunneling electron current oscillations. The annular rings 510 receive energy from the conductor 505 and couple the energy to the load 130. The position and size of the annular rings 510 determine the frequency which the annular rings 510 receive energy from the conductor 505.

Figure 6:
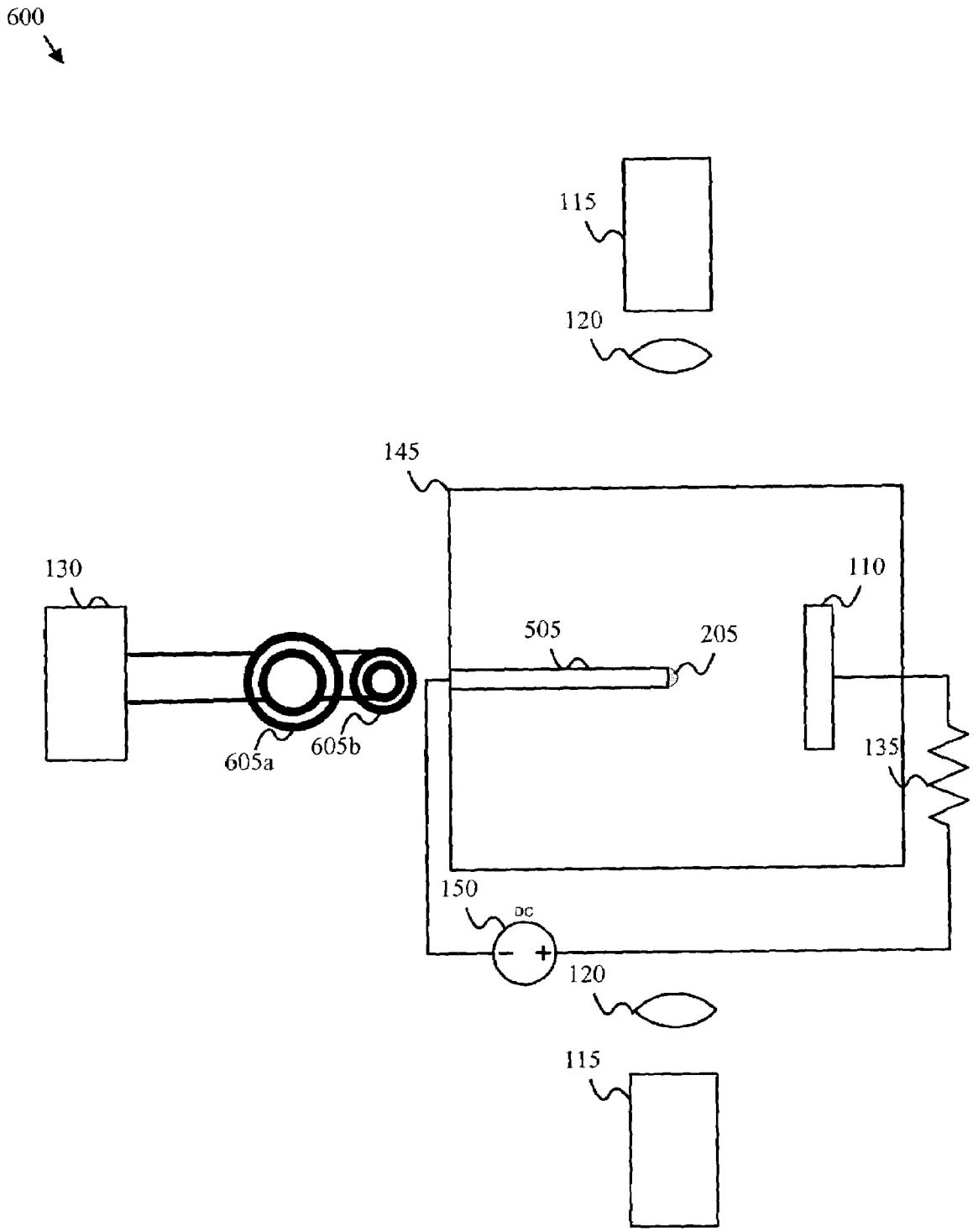
FIG. 6 is a schematic diagram illustrating one embodiment of a field emission system of the present invention.

FIG. 6 is a schematic diagram illustrating an alternative embodiment of a field emission system 600 of the present invention. The system 600 includes an emitting surface 205, an anode 110, one or more lasers 115, one or more optical devices 120, a load 130, a resistor 135, an evacuated chamber 145, a DC source 150, a conductor 505, and two or more sets of connected concentric annular rings 605. The concentric annular rings 605 form a log periodic antenna. The conductor 505 forms an antenna transmitting energy to the annular rings 605. The position, size, and interconnections of the annular rings 605 determine the frequency which the annular rings 605 receive energy from the conductor 505.

Figure 7:
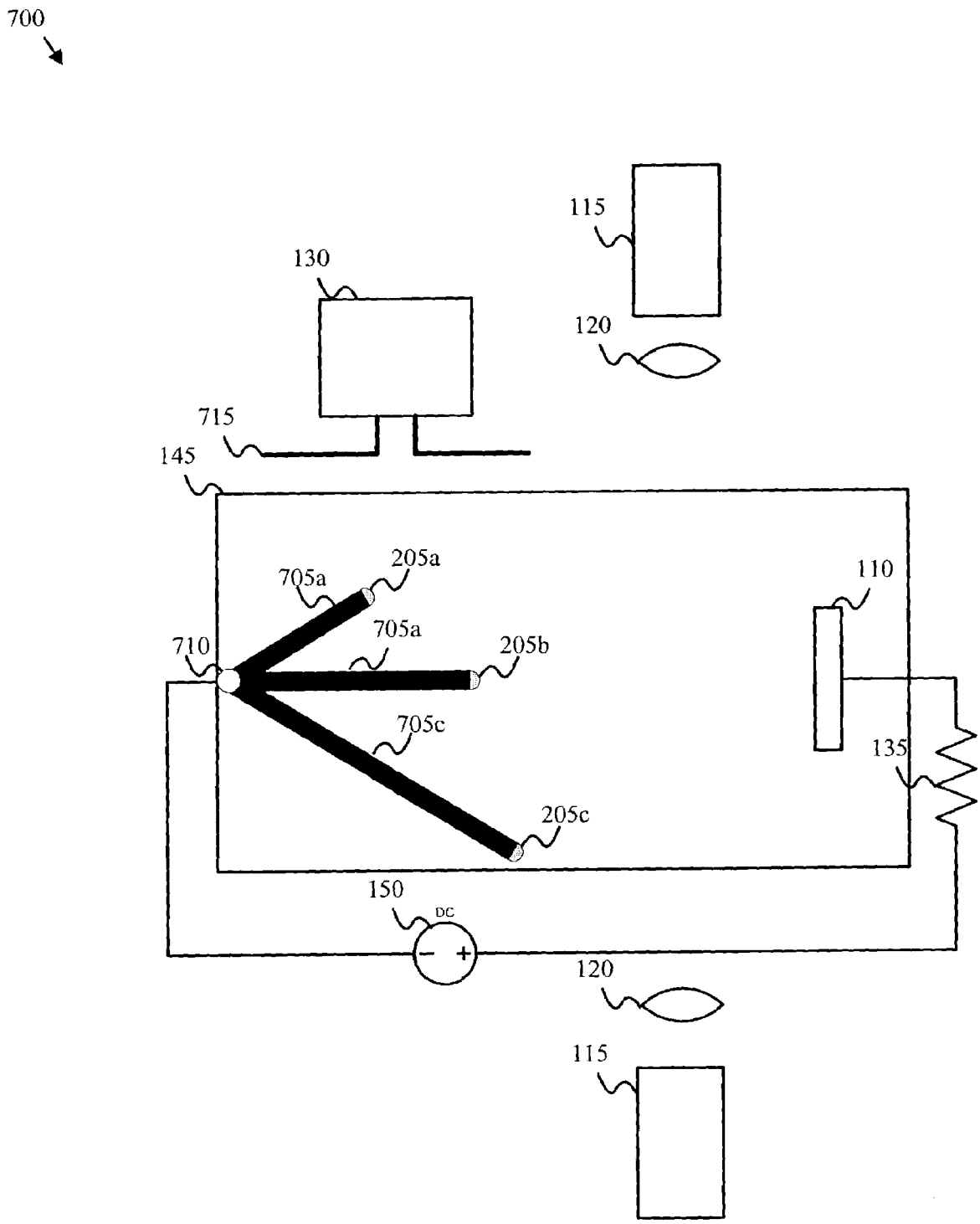
FIG. 7 is a schematic diagram illustrating one embodiment of a field emission system of the present invention.

FIG. 7 is a schematic diagram illustrating an alternative embodiment of a field emission system 700 of the present invention. The system 700 includes one or more conductors 705, each conductor having an emitting surface 205, an anode 110, one or more lasers 115, one or more optical devices 120, a resistor 135, an evacuated chamber 145, a DC source 150, an conductor impedance discontinuity 710, an antenna 715, and a load 130.

The conductors 705 form monopole antennas. In one embodiment, the conductors 705 have maximum radiation resistance when the length is approximately an integer multiple of one-fourth the wavelength for the tunneling electron current oscillations. Each conductor 705*a*, 705*b*, and 705*c* may have a unique length. The lasers 115 maybe focused separately to excite each antenna separately. Each of the conductors 705 has an impedance discontinuity 710 causing the conductor 705 to act as a resonant antenna. The conductors 705 radiate energy to the antenna 715. The antenna transmits energy to the load 130.

Figure 8:
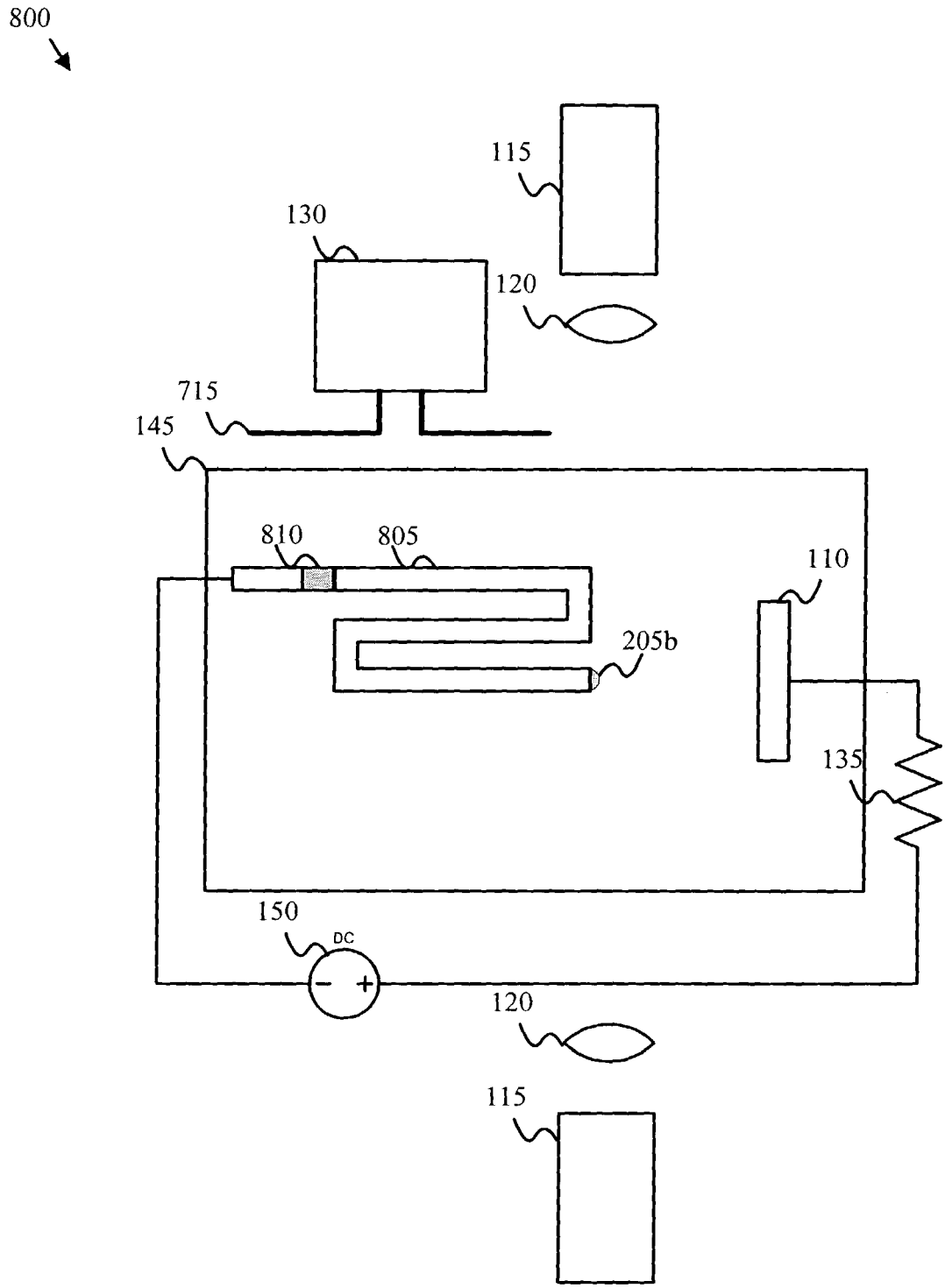
FIG. 8 is a schematic diagram illustrating one embodiment of a field emission system of the present invention.

FIG. 8 is schematic diagram illustrating an alternative embodiment of a field emission system 800 of the present invention. The system 800 includes an emitting surface 205, an anode 110, one or more lasers 115, one or more optical devices 120, a load 130, a resistor 135, an evacuated chamber 145, a DC source 150, an antenna 715, a folded monopole antenna 805, and an impedance discontinuity 810. In one embodiment, the total length of the folded monopole antenna 805 is approximately an integer multiple of one-fourth the wavelength for the tunneling electron current oscillations, giving the folded antenna 805 a high radiation resistance. The high radiation resistance increases the energy that is coupled to the antenna 715. The folded monopole antenna 805 has an impedance discontinuity 820 causing the folded monopole antenna 805 to act as a resonant antenna.

Figure 9:
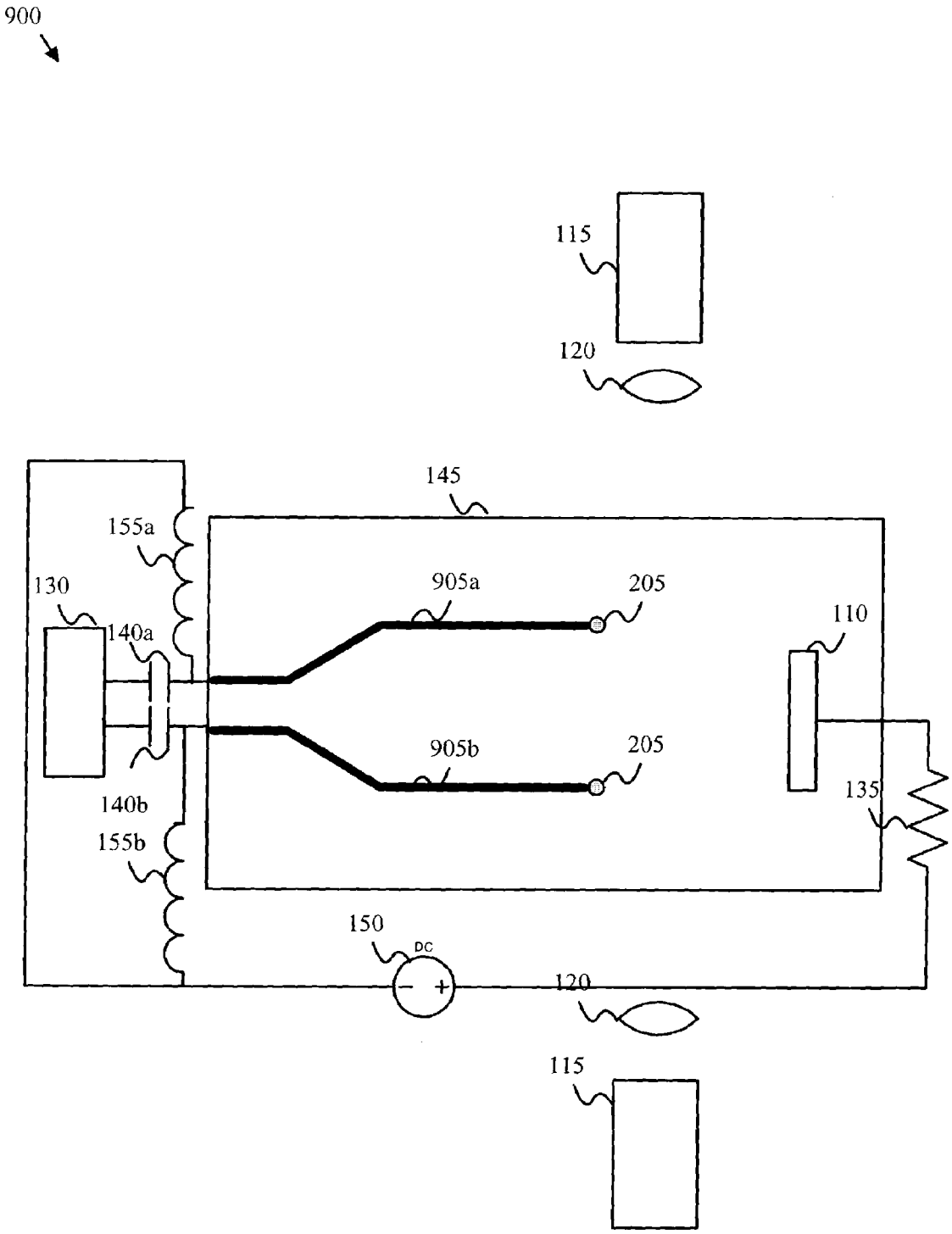
FIG. 9 is a schematic diagram illustrating one embodiment of a field emission system of the present invention.

FIG. 9 is a schematic diagram illustrating an alternative embodiment of a field emission system 900 of the present invention. The system 900 includes an anode 110, one or more lasers 115, one or more optical devices 120, a load 130, a resistor 135, two or more coupling capacitors 140, an evacuated chamber 145, a DC source 150, two or more RF chokes 155, and two or more parallel conductors 905, and two or more emitting surfaces 205. The parallel conductors 905 couple energy from the emitting surfaces 205 to the load 130. The spacing between the parallel conductors 905 is reduced near the load 130 to match the impedance of the load. The lasers 115 are focused on the emitting surfaces 205 to drive the parallel conductors 905 in push-pull. In one embodiment, the parallel conductors 905 are carbon nanotubes.

Figure 10:
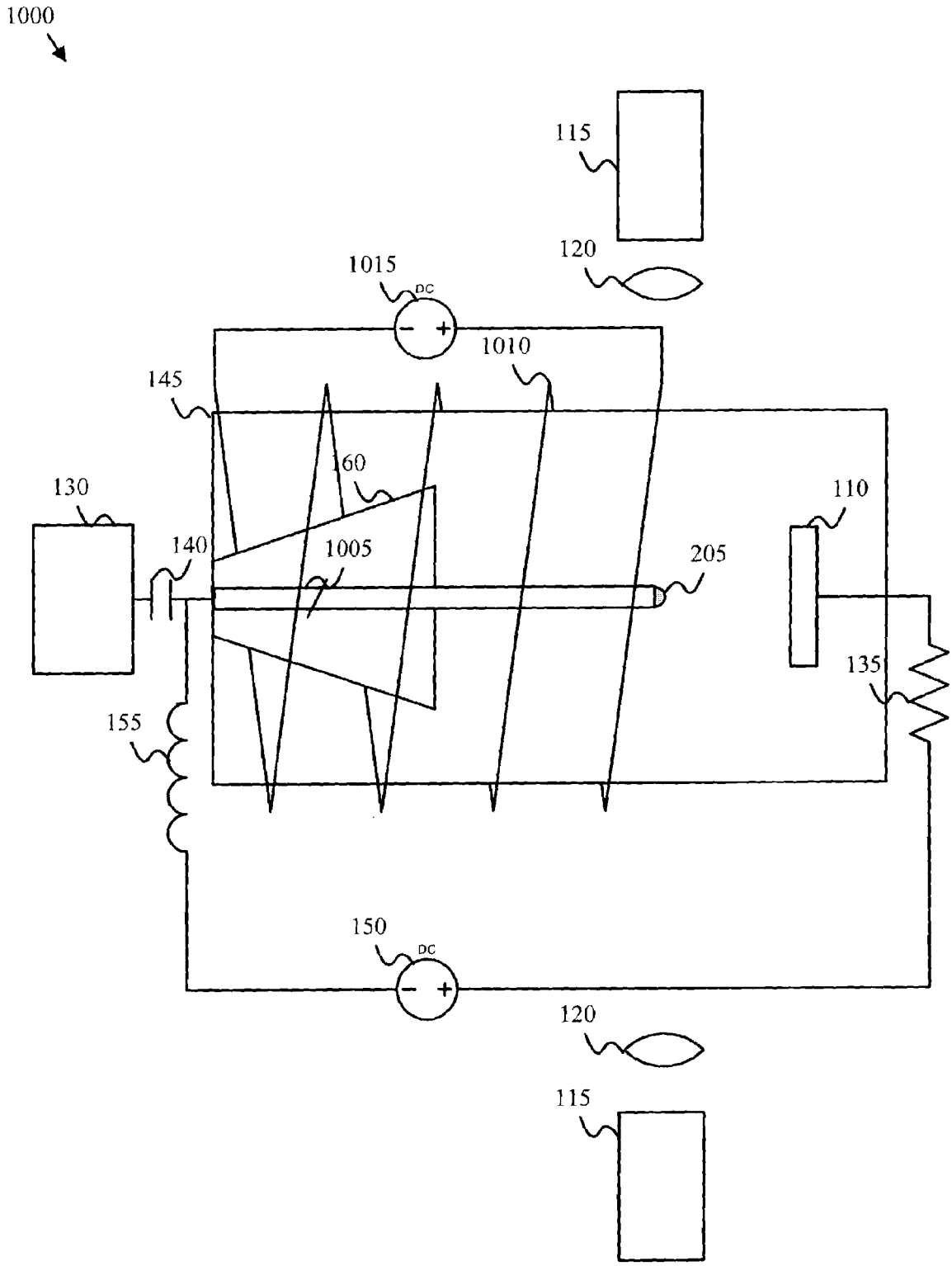
FIG. 10 is a schematic diagram illustrating one embodiment of a field emission system of the present invention.

FIG. 10 is a schematic diagram illustrating an alternvative embodiment of a field emission system 1000 of the present invention. The system 1000 includes an emitting surface 205, an anode 110, one or more lasers 115, one or more optical devices 120, a transmission device 125, a load 130, a resistor 135, a coupling capacitor 140, an evacuated chamber 145, a DC source 150, a RF choke 155, a horn transition 160, a ferrite cylinder 1005, a solenoid 1010, and a solenoid DC source 1015.

The ferrite cylinder 1005 is located within the solenoid 1010 and acts as a transmission device 210 to couple energy from the emitting surface 205 to the load 130. The solenoid DC source 1015 creates a static magnetic field parallel to the axis of the ferrite cylinder 1005. The electromagnetic permeability of the ferrite cylinder 1005 varies with the DC current of the solenoid DC source 1015. The gyromagnetic frequency of the ferrite cylinder 1005 also varies with the DC current. The ferrite cylinder 1005 transmits energy from the emitting surface 205 most efficiently at the gyromagnetic frequency because the permeability, and thus the characteristic impedance, is greatest at the gyromagnetic frequency. The high characteristic impedance increases the energy that is coupled to the load 130. By varying the solenoid DC source 1015 to change the gyromagnetic frequency different harmonics or mixer terms may be selectively coupled to the load 130.

Figure 11:
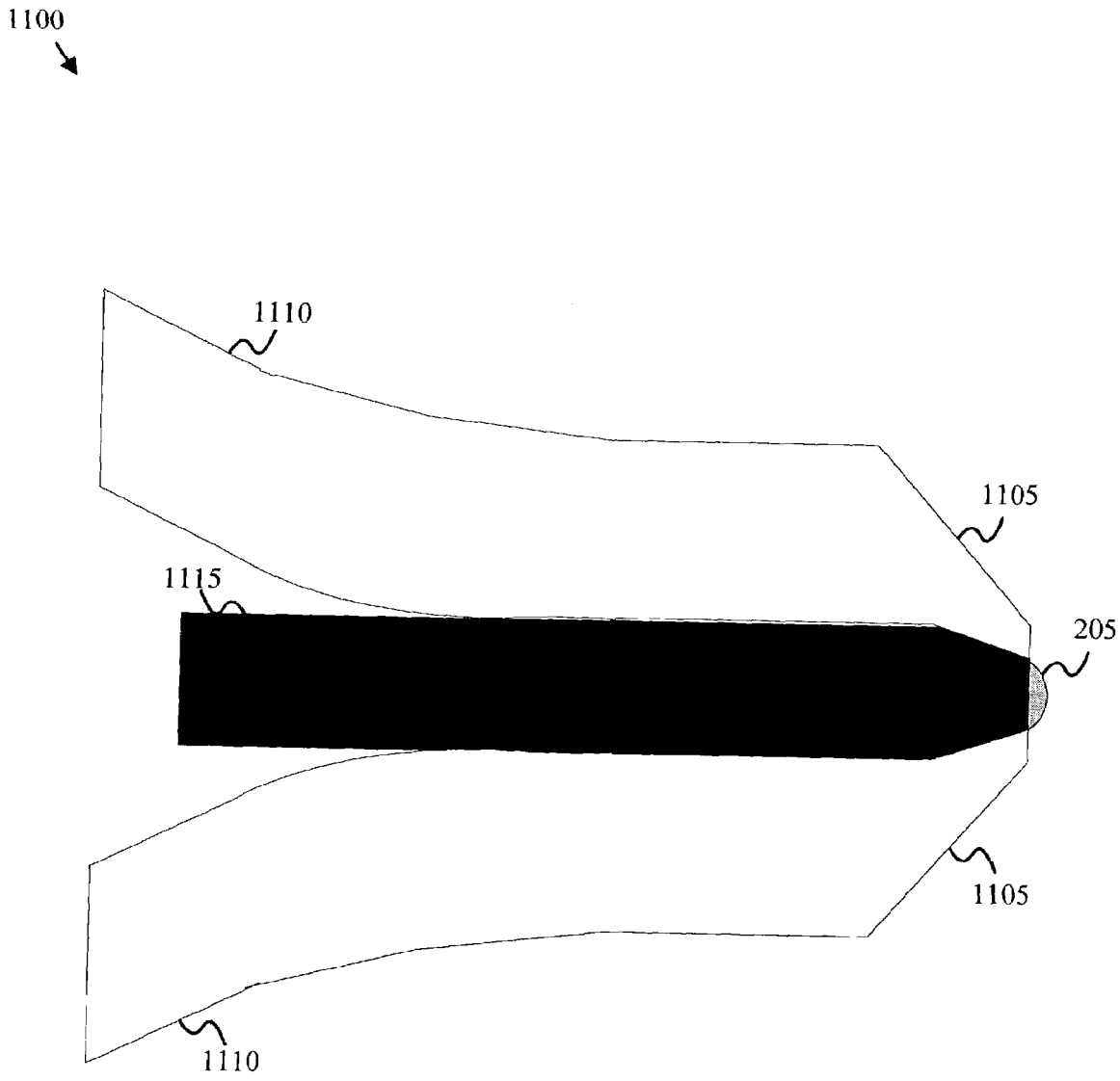
FIG. 11 is a cut-away drawing of one embodiment of a dielectric coated transmission device of the present invention.

FIG. 11 is a cut-away view of a field emission system 1100 of the present invention. The system 1100 includes an emitting surface 205, a dielectric coating 1105, two or more dielectric waveguides 1110, and a conductor 1115. The dielectric coating 1105 carries most of the energy from the emitting surface 205. The conductor 1115 is connected to a DC circuit for the field emission system 110. The dielectric waveguides 1110 carry the signal components of the energy from the dielectric coating 1105. The emitting surface 205 transitions to the dielectric coating 1105 over a short distance to reduce attenuation and to provide a large impedance value. In one embodiment, the thickness of the dielectric coating is greater than the diameter of the conductor 1105. For example, for a tungsten wire with a diameter of 200 nm, a high-resistance silicon dielectric of 12–14 μm thickness would provide an optimal impedance of 500 ohms at 1 THz. The dielectric coating 1105 extends over the conductor 1115 over a distance greater than or equal to three times the outer radius of the dielectric coating 1105.

The dielectric coating 1105 is divided into two or more dielectric waveguides 1110, the conductor 1115 continuing linearly to the DC circuit of the field emission system 1100. The dielectric waveguides 1110 are symmetric to avoid producing higher order azimuthally-dependent signal modes. The curvature of the dielectric waveguides 1110 is limited to reduce radiation losses. In one embodiment, the dielectric waveguides 1110 are connected to the loads and are tapered to match the impedance of each load. The dielectric waveguides 1110 may also be tapered to form tapered dielectric antennas to radiate the signals to the loads. In one embodiment, the radius of the conductor 1115 is less than 1 μm to limit the loss of the signal by propagating the signal on the conductor 1115 instead of on the dielectric waveguides.

Figure 12:
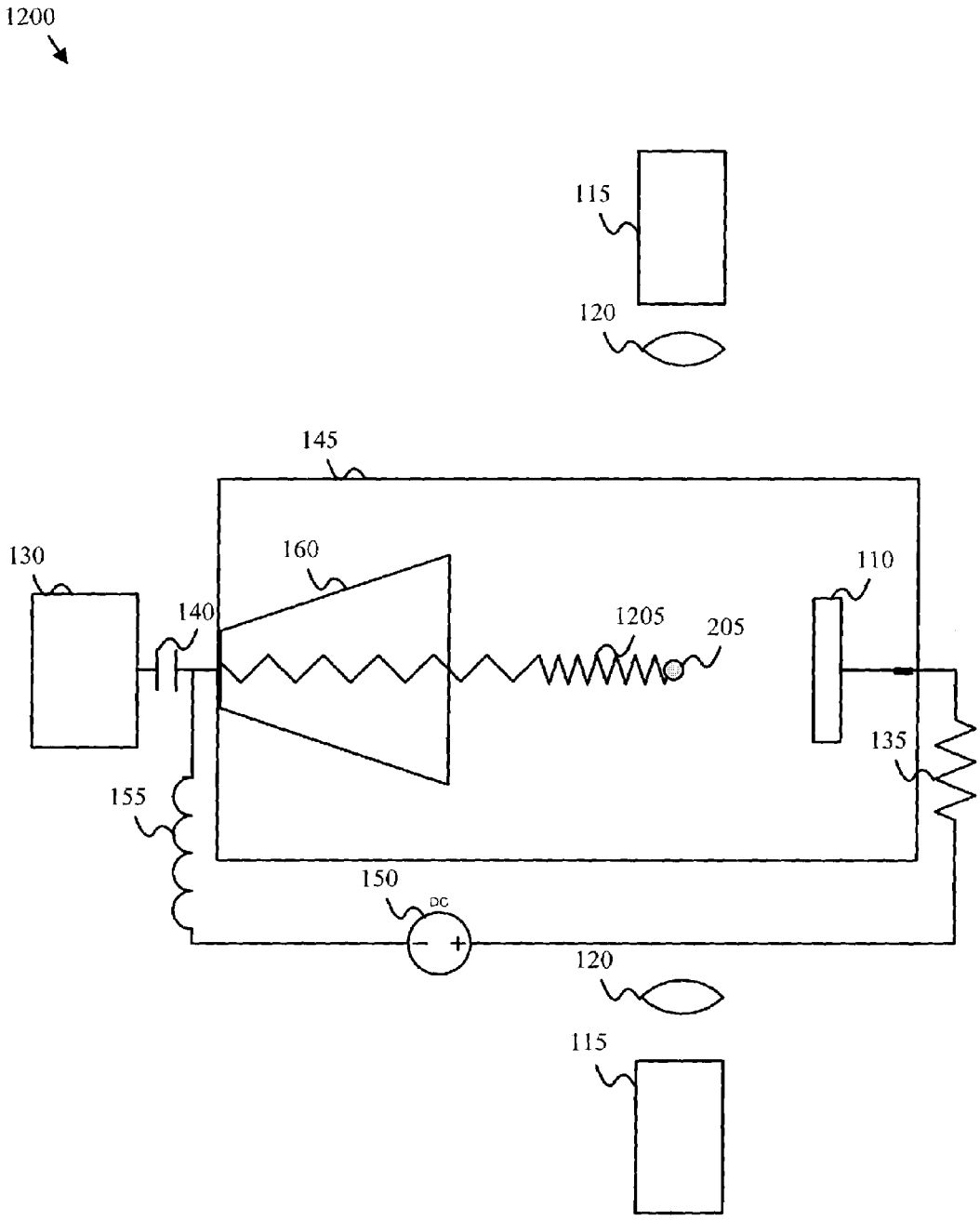
FIG. 12 is a schematic diagram illustrating one embodiment of a field emission system of the present invention.

FIG. 12 is a schematic diagram illustrating an alternvative embodiment of a field emission system 1200 of the present invention. The system 1200 includes an anode 110, one or more lasers 1115, one or more optical devices 120, a load 130, a resistor 135, a coupling capacitor 140, an evacuated chamber 145, a DC source 150, a RF choke 155, a horn transition 160, an emitting surface 205, and a conductor 1205. The conductor 1205 is wound in a helical shape. The helical winding increases the inductance per unit length of the conductor 1205, thus increasing the characteristic impedance and the energy coupled to the load 130. In one embodiment the conductor 1205 may have a radius of 200 nm, and the helix may have a radius of 730 nm with a pitch angle of 5 degrees, to provide an impedance of 650 Ohms at 1 THz. In another embodiment the characteristic impedance of the helix may be tapered by varying the radius or pitch angle so that a lower impedance is provided to match to the load.

Figure 13:
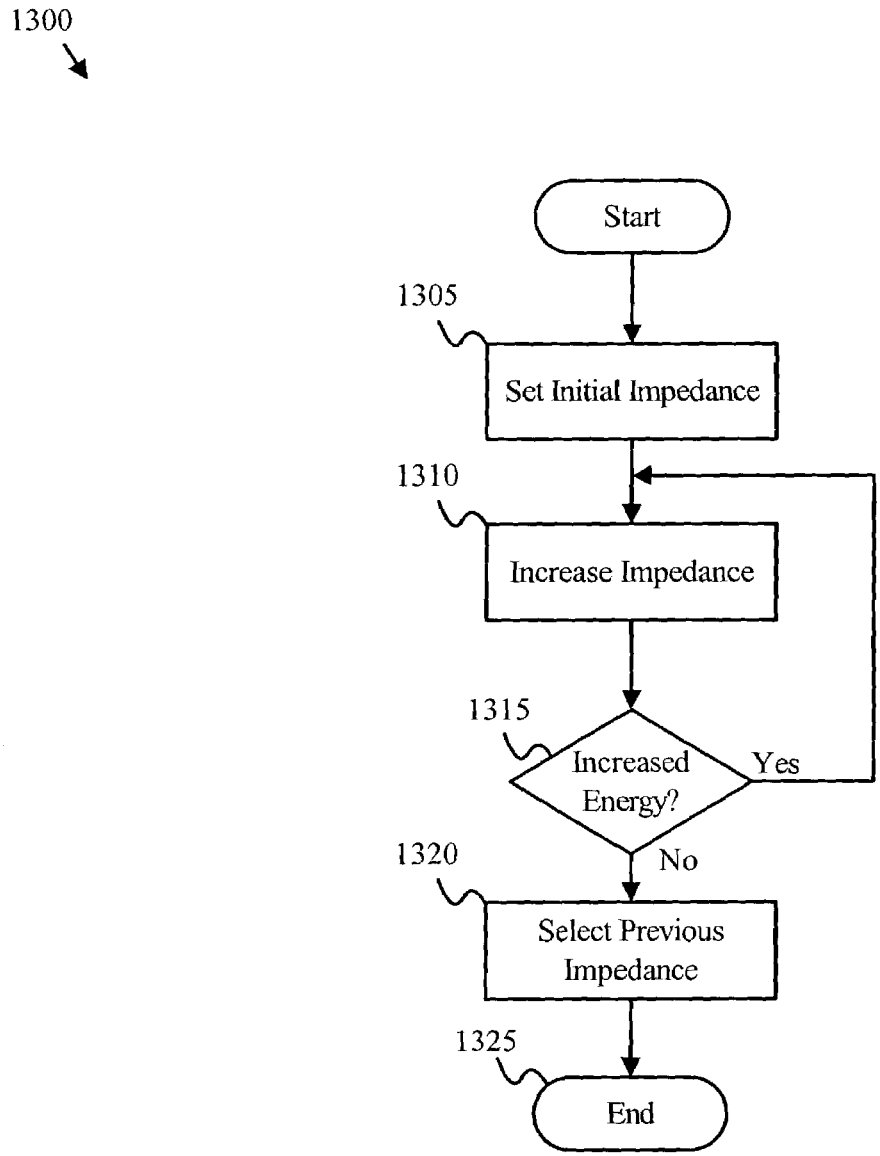
FIG. 13 is a flow chart diagram of one embodiment of a coupling impedance selecting method of the present invention.

FIG. 13 is a flow chart diagram depicting a coupling impedance selection method 1300 of the present invention. The method 1300 selects an optimum impedance for the coupling between the transmission device 210 and the emitting surface 205. The impedance selection method 1300 includes a set initial impedance step 1305, an increase impedance step 1310, an increased energy test 1315, a select previous impedance step 1320, and an end step 1325. Although for purposes of clarity the steps of the method 1300 are depicted in a certain sequential order, execution within an actual system may be conducted in parallel and not necessarily in the depicted order.

The set initial impedance step 1305 sets the impedance of the coupling between the emitting surface 205 and the transmission device 210 at an initial low impedance. The increase impedance step 1310 increases the impedance of the coupling by an incremental amount over the previous coupling impedance. The increased energy test 1315 determines if the energy coupled from the emitting surface 205 by the transmission device 210 increased with the increase in impedance. If the increased energy test 1315 determines that the total energy coupled increased, the method 1300 loops to the increase impedance step 1310.

If the increased energy test 1315 determines that the total energy coupled decreased, the method progresses to the select previous impedance step 1320. The select previous impedance step 1520 selects the previous coupling impedance as the optimum impedance.

The present invention enables the efficient coupling of high-frequency energy from a radiation-assisted field emission. By efficiently coupling energy, the present invention supports the creation of practical terahertz frequency sources for communication, data processing, imaging, and spectroscopy.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for efficient high-frequency energy coupling in radiation-assisted field emission, the apparatus comprising:

a radiation source configured to emit an electromagnetic field;

an emitting surface configured to receive at least one electromagnetic field, the emitting surface further configured with a diameter smaller than the wavelength of the effective electromagnetic field, wherein the emitting surface emits an oscillating tunneling electron current, the tunneling electron current responsive to the electromagnetic field;

a load having a load impedance;

a transmission device comprises a conducting ferrite coupled to the emitting surface and to the load, the transmission device, wherein the emitting surface and the transmission device comprise a carbon nanotube, figured to present the oscillating tunneling electron current with a very high transmission impedance, the output power responsive to the transmission impedance, and the transmission impedance configured to match the load impedance.

2. The apparatus of claim 1, wherein the transmission impedance is less than the impedance required to produce appreciable negative feedback sufficient to significantly reduce the output power from the transmission device.

3. The apparatus of claim 1, wherein the transmission impedance is tapered over a short distance.

4. The apparatus of claim 1, wherein the transmission device is configured with a ferrite coating.

5. The apparatus of claims 4, wherein a static magnetic field is applied parallel to the axis of the transmission device, causing gyromagnetic resonance of the ferrite and increasing the permeability and impedance of the transmission device.

6. The apparatus of claim 4, wherein the ferrite material comprises strontium-hexaferrite.

7. The apparatus of claim 1, wherein a static magnetic field is applied parallel to the axis of the transmission device, causing gyromagnetic resonance of the ferrite and increasing the permeability and impedance of the transmission device.

8. The apparatus of claim 1, wherein the ferrite material comprises strontium-hexaferrite.

9. The apparatus of claim 1, further comprising a second carbon nanotube, the carbon nanotubes forming the emitting surface and the transmission device, the nanotubes further joined together at a common junction, the junction coupled to a load.

10. The apparatus of claim 9, wherein the impedance of the carbon nanotubes matches the impedance of the load.

11. The apparatus of claim 1, wherein the transmission device comprises two or more parallel conductors each having an emitting surface.

12. The apparatus of claim 11, wherein the spacing between the parallel conductors is reduced near the load.

13. The apparatus of claim 12, wherein the impedance of the parallel conductors matches the impedance of the load.

14. The apparatus of claim 13, wherein the impedance of the parallel conductors matches the impedance of the load.

15. The apparatus of claim 11, wherein the parallel conductors are joined together at a common junction, the junction coupled to a load.

16. The apparatus of claim 11, wherein the parallel conductors comprise carbon nanotubes.

17. The apparatus of claim 16, wherein the spacing between the carbon nanotubes is reduced near the load.

18. The apparatus of claim 17, wherein the impedance of the carbon nanotubes matches the impedance of the load.

19. The apparatus of claim 1, wherein the transmission device comprises an antenna, the antenna configured to have a high radiation resistance.

20. The apparatus of claim 19, wherein the antenna is coupled with a receiving antenna.

21. The apparatus of claim 20, wherein the receiving antenna comprises a dipole antenna.

22. The apparatus of claim 21, wherein the receiving antenna comprises a log periodic antenna.

23. The apparatus of claim 21, wherein the dipole antenna comprises at least two concentric annular rings.

24. The apparatus of claim 20, wherein the receiving antenna comprises a plurality of concentric annular rings, the annular rings connected to form a log periodic antenna.

25. The apparatus of claim 19, wherein the antenna comprises a single conductor, the length of the conductor greater than the wavelength of the oscillating tunneling electron current.

26. The apparatus of claim 19, wherein the antenna comprises a resonant monopole antenna, the resonant antenna having a total length equal to an integer multiple of one-quarter of the wavelength of the oscillating tunneling electron current.

27. The apparatus of claim 26, wherein the resonant antenna is configured with a distal end and a proximal end, the proximal end switchably coupled with the emitting surface.

28. The apparatus of claim 26, wherein the resonant antenna is configured with a distal end and a proximal end, the proximal end coupled with the electron emitting surface, the distal end further switchably coupled with a reflective impedance.

29. The apparatus of claims 28, further comprising a plurality of resonant antennas, each further switchably coupled with a reflective impedance.

30. The apparatus of claim 19, wherein the antenna comprises a resonant antenna.

31. The apparatus of claim 30, wherein the resonant antenna is configured as a folded monopole antenna, the length of each fold an integer multiple of one-quarter of the wavelength of the oscillating tunneling electron current.

32. The apparatus of claims 19, wherein the antenna is configured as a plurality of resonant antennas, each resonant antenna configured with a distal end and a proximal end, each proximal end switchably coupled with the electron emitting surface.

33. The apparatus of claim 1, wherein the emitting surface is biased with a static electric field that has a range of 2 to 9 Volts/nm.

34. The apparatus of claim 33, wherein the static electric field is pulsed, the pulse duration being no more than one microsecond.

35. The apparatus of claim 1, wherein the electromagnetic field is pulsed.

36. The apparatus of claim 1, wherein the electromagnetic field is directed by an optical fiber.

37. The apparatus of claim 1, wherein the wavelength of the electromagnetic field is selected such that one photon will elevate a tunneling electron above the potential barrier at the emitting surface to an energy where one complete cycle between the classical turning points of the tunneling electron reinforces the wave function of the tunneling electron.

38. The apparatus of claim 1, wherein the wavelength of the electromagnetic field is selected such that there is little or no resonant reinforcing of the wave function of the tunneling electron.

39. The apparatus of claim 1, wherein the transmission device comprises two or more branching conductors.

40. The apparatus of claim 39, wherein the branching conductors comprise ferrite transmission lines.

41. A method for selecting the impedance of a transmission device, the method comprising:

increasing the impedance of a coupling between a transmission device an emitting surface in a radiation-assisted field emission device, the transmission device coupled to a load, the emitting surface generating a tunneling electron current;

selecting the impedance where the decrease in coupling energy power resulting from the incremental negative current feedback produced by the increased impedance of the coupling between the transmission device and the emitting surface exceeds the incremental increase in coupling energy power from the increased impedance; and transmitting the current through a plurality of branching carbon nanotubes and a plurality of a branching ferrite transmission lines coupled to the load at a common junction.

42. The method of claim 41, further comprising transmitting the current through a plurality of branching transmission lines coupled to the load at a common junction.

43. A system for high-frequency energy coupling to a field emission current source, the system comprising:

an evacuated chamber;

a radiation source configured to emit an electromagnetic field;

a plurality of emitting surfaces configured to receive at least one electromagnetic field, the plurality of emitting surfaces each further configured with a diameter smaller than the wavelength of the effective electromagnetic field, wherein the plurality of emitting surfaces each emits an oscillating tunneling electron current, the tunneling electron current responsive to the electromagnetic field;

a load;

a transmission device comprising a plurality of transmission lines, each transmission line coupled to an emitting surface, wherein the transmission device presents the oscillating tunneling electron cunent with a high impedance, the output power responsive to the high impedance, the transmission lines being coupled to the load at a common junction; wherein the plurality of transmission lines comprise ferrite transmission lines and carbon nanotubes.

44. The system of claim 43, wherein the impedance of the transmission device is configured to create a photomixer, the photomixer responsive to the frequency of the electromagnetic radiation and the impedance of the transmission.

45. The system of claim 43, wherein the transmission device is configured to pass the energy at selected harmonics or mixer terms that are formed in the tunneling electron current oscillations.

46. The system of claim 43, wherein the system is configured to input high-frequency energy to create electric field oscillations at the emitting surface to modulate the field emission current and modulate the radiation from one or more sources of radiation.

* * * * *

UNITED STATES PATENT AND TRADEMARK OFFICE

CERTIFICATE OF CORRECTION

PATENT NO. : 7,141,781 B2
APPLICATION NO. : 10/459828
DATED : November 28, 2006
INVENTOR(S) : Mark J. Hagmann It is certified that error appears in the above-identified patent and that said Letters Patent is hereby corrected as shown below:

Column 11

Line 9 reads "figured to" Should read -- configured to --

Signed and Sealed this

Sixth Day of February, 2007

JON W. DUDAS
*Director of the United States Patent and Trademark Office*